US007264512B2

(12) United States Patent
Wolford et al.

(10) Patent No.: US 7,264,512 B2
(45) Date of Patent: Sep. 4, 2007

(54) PCI EXPRESS CONNECTOR

(75) Inventors: Robert Russell Wolford, Raleigh, NC (US); Jonathan Andrew Duncan, Brentwood, TN (US); Daniel Paul Kelaher, Holly Springs, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/306,294

(22) Filed: Dec. 21, 2005

(65) Prior Publication Data

US 2007/0141914 A1 Jun. 21, 2007

(51) Int. Cl.
*H01R 24/00* (2006.01)

(52) U.S. Cl. ..... 439/637; 439/636

(58) Field of Classification Search ..... 439/62, 439/636, 637

See application file for complete search history.

(56) References Cited

U.S. PATENT DOCUMENTS 4,439,000 A * 3/1984 Kaufman et al. ..... 439/637
5,171,154 A * 12/1992 Casciotti et al. ..... 439/67
5,454,084 A 9/1995 Uchikoga
6,159,052 A 12/2000 Meng et al.
6,290,513 B1 9/2001 Kakinoki et al.
6,296,491 B1 * 10/2001 Pickles ..... 439/60
6,481,629 B1 11/2002 Hirabayashi et al.
6,814,583 B1 * 11/2004 Young et al. ..... 439/65
2003/0054695 A1 * 3/2003 Kikuchi et al. ..... 439/636
2003/0090879 A1 5/2003 Doblar et al.
2005/0277337 A1 * 12/2005 Chen et al. ..... 439/637

* cited by examiner

*Primary Examiner*—James R. Harvey
*Assistant Examiner*—Travis Chambers
(74) *Attorney, Agent, or Firm*—Gerald J. Iwanejko, Jr.; Cynthia S. Byrd

(57) ABSTRACT

A method, apparatus and system are disclosed for a Peripheral Component Interconnect ("PCI") Express connection device that supports use of device bus widths different than the size of the connector in communication of data processing, addressing and/or control signals between electronic and/or computer devices. Specifically, a PCI Express connector is disclosed that allows installation of a PCI Express adapter having a larger bus width than that of the connector itself, by including an opening (or "notch") in at least one end of the connector to physically accommodate the larger dimension(s) of the adapter.

21 Claims, 6 Drawing Sheets

PCI EXPRESS CONNECTOR

TECHNICAL FIELD

This invention relates to electronic device connectors in general, and specifically to printed circuit board (PCB) edge connectors meeting the Peripheral Component Interconnect ("PCI") Express technical standard for electronic and computer devices. More particularly, this invention relates to a PCI Express connection device that supports use of device bus widths different than the size of the connector in communication of data processing, addressing and/or control signals between such devices. Specifically, a PCI Express connector is disclosed that allows installation of a PCI Express adapter having a larger bus width than that of the connector itself, by including an opening (or "notch") in at least one end of the connector to physically accommodate the larger dimension(s) of the adapter.

BACKGROUND

Most electronic and computer circuitry is now implemented with active and passive devices coupled together through use of a printed circuit board (PCB). This is true whether the circuitry is primarily analog in nature, digital in nature, or a hybrid of the two. In its simplest form, a PCB is a relatively thin sheet of dielectric (i.e. electrically non-conductive) material such as a resin-filled fiberglass. Metal lines or "traces" are typically formed on one or more surfaces of the PCB to provide electrical connection(s) between components of the various electronic circuits located on the PCB. Furthermore, PCBs can be "multi-layered" where multiple dielectric layers are located between conductive layers to form circuit, ground and/or power planes. With multi-layer boards, it is common to provide electrical connections between various layers by the formation of "vias" (or conductive plugs) between layers, or by use of "through-holes" in which conductors can be threaded. Commonly, the circuit(s) on a PCB can be connected to other devices. These may be input/output devices, other electronic and/or computer circuits located on other PCBs, transmission lines, etc. While such devices can be connected directly to a PCB (such as by being soldered to some of its traces or bonding pads), the connection to external devices or circuits is most commonly made through a removable connector assembly. Many different types of electrical connectors have been developed through the years for this purpose, and they have been designed according to several industry technical standards in order to create uniformity in their manufacture, implementation and use.

One of the most widely adopted of such standards currently used in desktop and server computing is the Peripheral Component Interconnect (or "PCI") standard. The original IBM® personal computer (PC) architecture had a series of related hardware communication interface (or "bus") designs rooted in the original Industry Standard Architecture (ISA) specification that led to development and adoption of the PCI standard. The original ISA specification allowed for a bus having a size (or "width") of 16 binary information-containing digits (or "bits" in forming a binary "word") to carry electrical signals transmitted simultaneously (or "in parallel") for use in executing computer device addressing, data processing and control functions. However, the ISA bus architecture has a number of drawbacks, including lack of speed, being difficult to configure, and an incomplete set of standard specifications, all leading to a lack of compatibility for use with some applications. For this reason, several other proprietary bus architectures have been developed that are considered to be technically superior to ISA; including a 32-bit variant of ISA (EISA); the Micro Channel Architecture (MCA) bus developed by IBM®; NuBus developed by Apple®; SBus developed by Sun®; Zorro II (16-bit) and Zorro III (32-bit) used by Amiga; the VESA Local bus developed by the Video Electronics Standards Association; and the PCI standard which was developed by Intel®.

The PCI specification was first proposed as a standard in 1991, and it was originally designed for interconnecting circuits and devices on a PCB main circuit board (or "motherboard"), but its use has since been expanded to removable circuit cards and other computer and electronic devices. The PCI bus architecture possesses a number of advantages over other bus architectures; such as providing direct access to computer system memory without central processing unit ("CPU") intervention; allowing for interconnection of multiple electronic and/or computer devices through a single bus (including the use of "bridges" that allow a single interconnection to be used for a connection to even more devices) and automatic configuration (or "auto-configuration") capability. Because of these advantages (among others) along with its speed and relatively inexpensive implementation, the PCI bus architecture standard is now used in virtually every type of computer and electronic system for providing communication between hardware devices.

PCI Express is the latest development in the PCI standard to support use of connectors, expansion adapters and peripheral devices in PCs, workstations, servers, and other types of computer and electronic hardware. The bus technology implemented by the PCI Express standard can be used to provide microchip, printed circuit board (PCB), and adapter connectivity allowing communication between hardware devices in various types of computer and electronic systems. This is accomplished by implementation of a "serial" interface that allows for sequential transmission of data using point-to-point interconnections between devices, with directly wired interfaces between these connection points that usually consists of a connector/adapter combination. The PCI-X and PCI Express standards remain compatible at the software level even though the underlying hardware technology is different between the two standards. This permits PCI-X based operating systems, device drivers and BIOS systems to support PCI Express based hardware devices without any significant changes.

The PCI Express standard is not limited to use with connectors for adapters. Due to its high speed and scalable bus widths, it can be used as a high speed interface to connect many different devices incorporating different hardware designs, such as USB 2, Infiniband, Gigabit Ethernet, and others. Devices can currently be operated under the PCI Express standard at a speed which is over double the bandwidth capability of current PCI-X devices. Future system operating frequency increases and improvements in conductor materials will cause corresponding increases in the total bandwidth that the PCI Express standard is capable of supporting.

SUMMARY OF THE INVENTION

A method, apparatus and system are disclosed for a connection device that supports use of device bus widths different than the size of the connector in communication of data processing, addressing and/or control signals between electronic and/or computer devices. Specifically, a Peripheral Component Interconnect ("PCI") Express connector is disclosed that allows installation of a PCI Express adapter having a larger bus width than that of the connector itself.

The PCI Express specification allows a device having a larger (or "wider") bus capacity to be electrically connected to a smaller (or "narrower") bus. However, a mechanical limitation exists with each type of PCI Express connector currently used to connect the bus to the device adapter, since the physical dimension(s) of the connector do not support its use with an adapter having a wider bus interface than that of the connector itself. All current solutions to this problem use a PCI Express connector having a bus width at least as large as that of the installed adapter while wiring only a portion of the connector to the system bus for use with the adapter.

The present invention solves these problems by providing a new type of PCI Express connector that allows installation of a PCI Express adapter having a larger bus width than that of the connector, by including an opening (or "notch") in at least one end of the connector to physically accommodate the larger dimension(s) of the adapter. The "notch" concept of this invention eliminates the disadvantages experienced with current solutions while also allowing the connector to be compliant with the PCI Express specification, and it can be used to manufacture a variety of different PCI Express connectors as well as connectors for other expansion busses.

It is therefore an object of the present invention to overcome the disadvantages of the prior art by providing a method, apparatus and system using a connection device that supports use of device bus widths different than the size of the connector in communication of data processing, addressing and/or control signals between electronic and/or computer devices.

It is another object of the present invention to overcome the disadvantages of the prior art by providing a connector that supports use of device bus widths different than the size of the connector in communication of data processing, addressing and/or control signals between electronic and/or computer devices meeting the Peripheral Component Interconnect ("PCI") Express technical standard.

It is another object of the present invention to overcome the disadvantages of the prior art by providing a PCI Express connector that allows installation of a PCI Express adapter having a larger bus width than that of the connector itself.

It is another object of the present invention to overcome the disadvantages of the prior art by providing a PCI Express connector that allows installation of a PCI Express adapter having a larger bus width than that of the connector, by including an opening (or "notch") in at least one end of the connector to physically accommodate the larger dimension (s) of the adapter.

The subject matter which is regarded as the invention is particularly pointed out and distinctly claimed in the concluding portion of the specification. The invention, however, together with further objects and advantages thereof, may best be understood by reference to the following description taken in conjunction with the accompanying drawings.

BRIEF DESCRIPTION OF THE DETAILED DRAWINGS

DETAILED DESCRIPTION OF THE PREFERRED EMBODIMENTS

Figure 3:
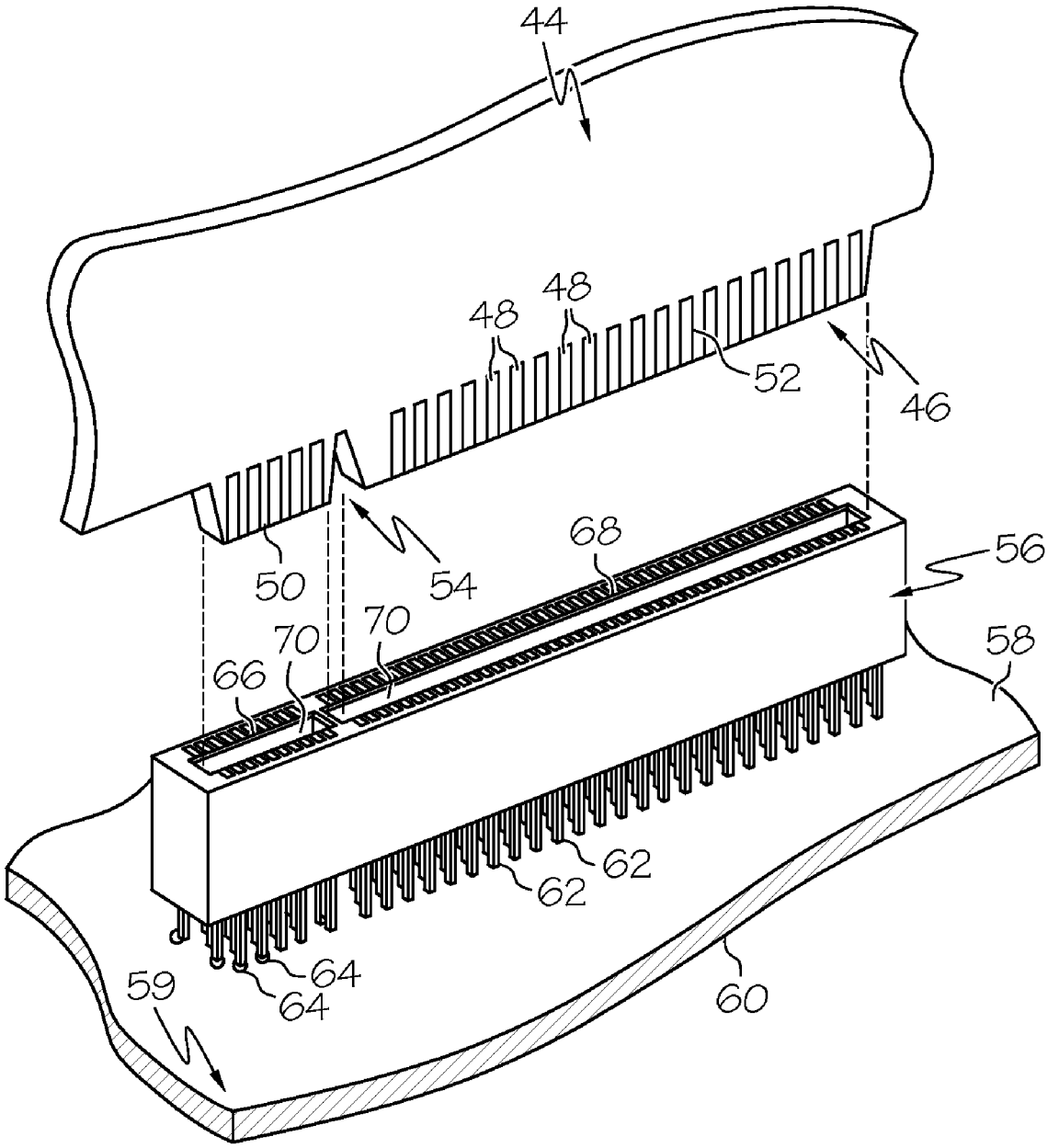
FIG. 3 (PRIOR ART)
FIGS. 3 & 4 are perspective views illustrating a plug-in card edge connector system of the prior art.
Figure 4:
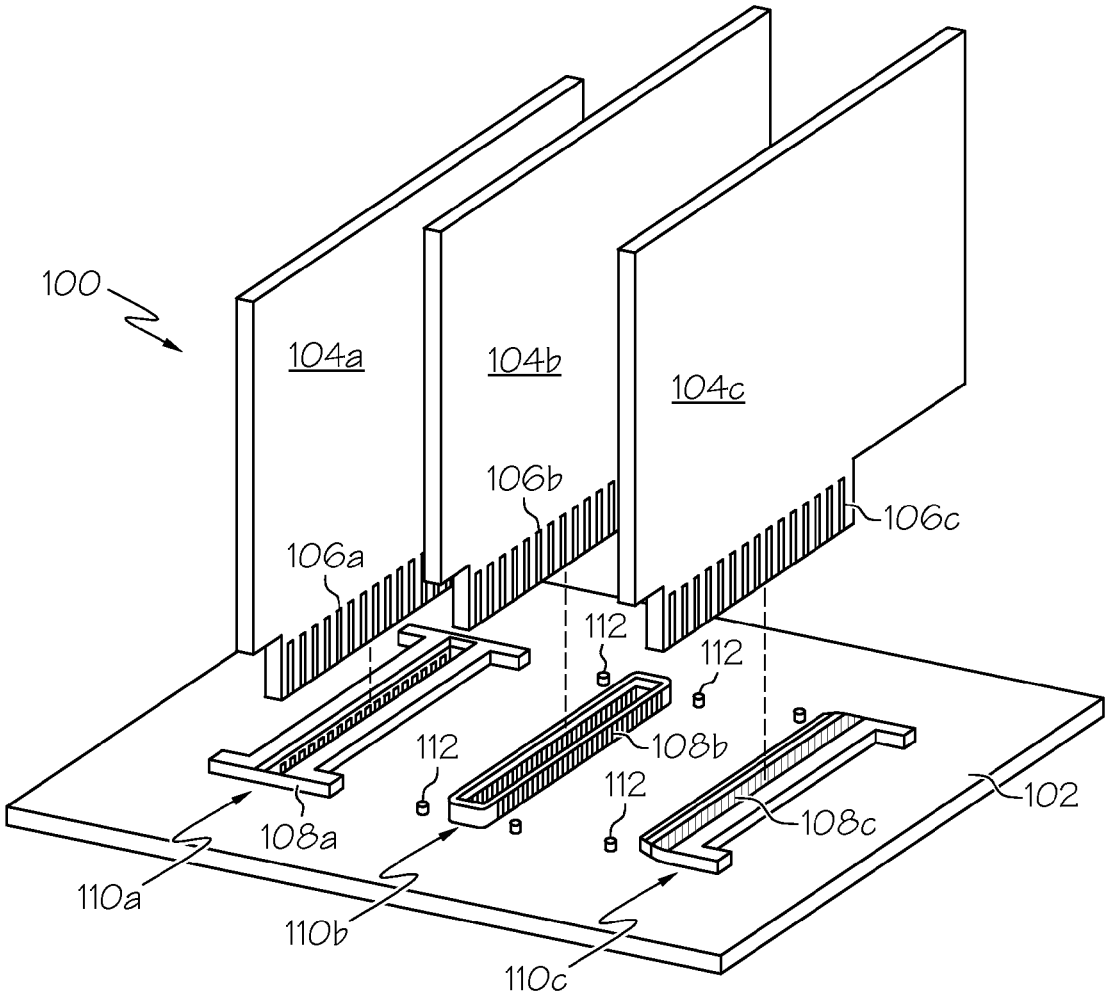
FIG. 4 (PRIOR ART)

FIGS. 3 & 4 illustrate a prior art printed circuit board (PCB) edge connection system that can be utilized under the PCI standard, as shown and described in U.S. Pat. No. 6,814,583 which is incorporated by reference herein. These connectors can be used to couple physically separated electronic devices, and although the connectors are shown to be attached to PCBs in FIGS. 3 & 4, either connector could instead be coupled to a cable or to an individual circuit card.

As shown in FIG. 3, a first PCB or "plug-in board" 44 includes a male edge connector 46, which can be implemented as a portion of the PCB with traces 48 that electrically connect with contacts 70 of a female edge connector 56. In this particular example, the male edge connector 46 has a first portion 50 and a second portion 52 separated by a slot 54. (There are also unslotted variants of edge connectors in the prior art.) The female edge connector 56 is provided with a pair of slots 66 and 68 including a number of contacts 70 which couple to the pins 62. By extending its pins 62 through holes 64, the female edge connector 56 can be electrically coupled to a PCB 58 having traces on its bottom surface 60 (not shown) although traces can also be located on a top surface 59 of the PCB. In operation, first and second portions 50 & 52 of male edge connector 46 are respectively inserted into slots 66& 68 of female edge connector 56, causing the traces 48 of plug-in board 44 to come into electrical contact with the traces of PCB 58 (not shown) through contacts 70 and pins 62.

FIG. 4 shows a prior art edge connector system 100 that includes a PCB motherboard 102 and one or more plug-in circuit cards 104*a*, 104*b* and/or 104*c*. Each of the circuit cards includes a male edge connector portion 106*a*, 106*b* and/or 106*c*, respectively, which can be a physical extension of the circuit card. Male edge connectors 106*a*, 106*b* and 106*c* are adapted to engage the slots 108*a*, 108*b* and 108*c* of female edge connectors 110*a*, 110*b* and 110*c*, respectively. As a result, electronic circuitry on circuit cards 104*a*-104*c* is electrically connected to circuitry on motherboard 102 when male edge connectors 106*a*-106*c* are engaged with female edge connectors 110*a*-110*c*.

The connectors illustrated in FIGS. 3 & 4 have several advantages. They are mechanically guided and secured into place, which aids in retention of the electrical contact they make with each other. They are also well-shielded by their shells, which reduces electromagnetic radiation interference (EMI). Both types of connectors can vary in configuration and can assume a split-connector design as described with reference to FIG. 3 above. The edge connector technology illustrated in FIGS. 3 & 4 has certain advantages over other prior art systems, including the elimination of a separate male connector that reduces cost and brings the ground planes of the two PCBs closer together, which can be advantageous in high frequency applications. However, these prior art edge connector designs are intended for use with devices that implement a shared, parallel bus architecture for simultaneous signal processing. As explained above, the PCI Express standard implements a serial interface that allows for point-to-point interconnections between devices using directly wired interfaces between these connection points, requiring a different type of connector to satisfy this standard.

Figure 1:
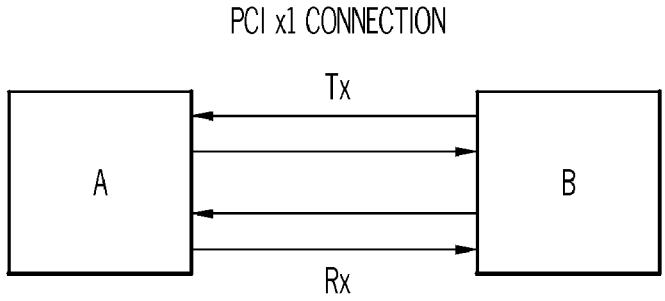
FIG. 1 is a schematic diagram illustrating a PCI Express serial link electrical connection.

As shown in FIG. 1, a single PCI Express serial link is a dual-simplex connection using two pairs of wires (or "lanes"), one pair for transmitting data (Tx) and one pair for receiving data (Rx), that can each transfer one bit per cycle between connected devices A and B at a current speed of 2.5 gigabits per second (Gbps). A PCI Express link may be comprised of multiple lanes. In such configurations, the connection is labeled as ×1, ×2, ×4, ×8, ×16 or ×32 (or larger), etc., where the "x number" is effectively the number of lanes used in the link. Thus, a PCI Express ×1 configuration requires four (4) wires to connect the single-lane link, whereas an ×16 implementation requires sixteen (16) times that amount (or 64 wires) to complete the sixteen-lane link. This results in differently sized mechanical connections (or "slots") for each different PCI Express link configuration.

Figure 2:
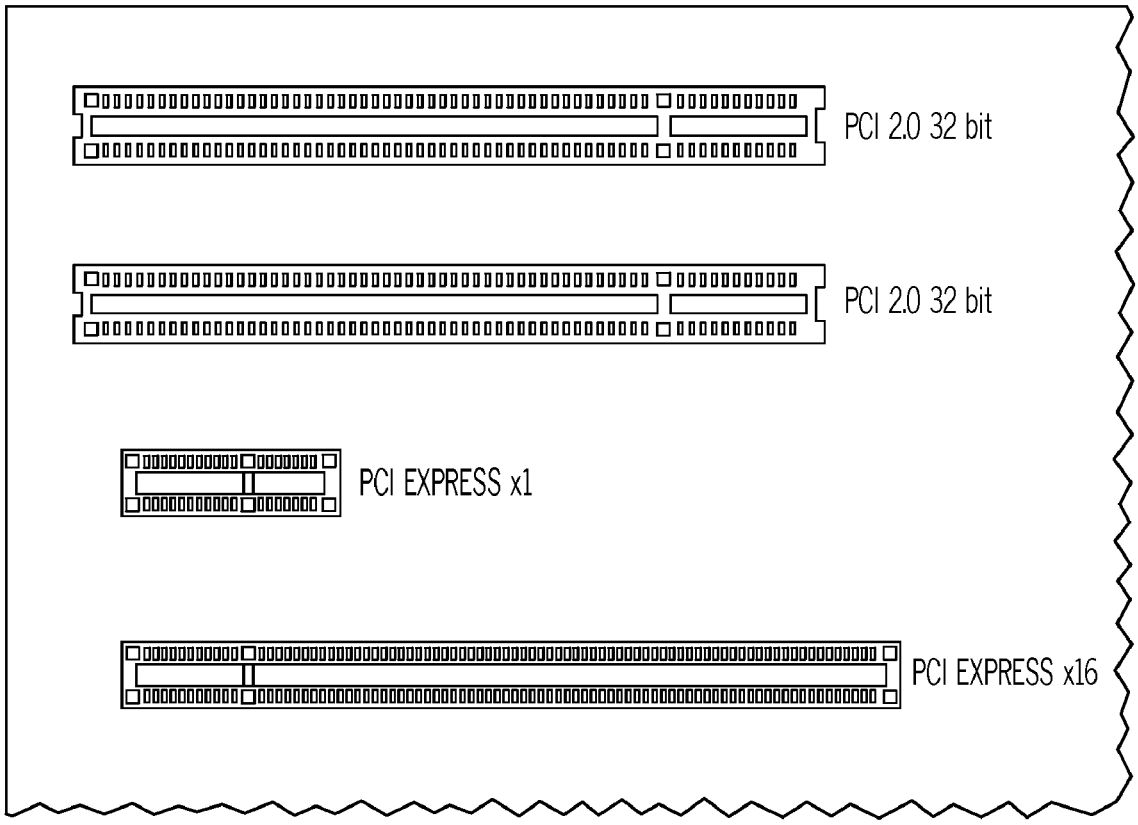
FIG. 2 illustrates a comparison of mechanical slot sizes for various PCI and PCI Express connector/adapter configurations.

FIG. 2 shows a comparison of the slot sizes for current 32-bit PCI 2.0, PCI Express ×1 and PCI Express ×16 connector/adapter configurations, respectively. It is clear from this figure that a PCI Express adapter can be installed into a slot designed for a larger connection but a not smaller one. For example, a PCI Express ×16 adapter will not physically fit into a PCI ×1 connector slot, whereas a PCI Express ×1 adapter can be installed into a PCI ×16 connector slot. This compatibility is shown in the table below.

| | x1 slot | x4 slot | x8 slot | x16 slot |
|---|---|---|---|---|
| X1 card | Supported | Supported | Supported | Supported |
| X4 card | No | Supported | Supported | Supported |
| X8 card | No | No | Supported | Supported |
| X16 card | No | No | No | Supported |

As explained above, the PCI Express specification allows a device having a larger (or "wider") bus capacity to be electrically connected to a smaller (or "narrower") bus, such as for example by connecting a PCI Express ×16 device (having a 16-bit "word"-sized bus architecture) to a PCI Express ×8 (single-byte), ×4 (half-byte), or ×1 (single bit) bus through an adapter. However, as illustrated with reference to FIG. 2, a mechanical limitation exists with each type of PCI Express connector currently used to connect the bus to the device adapter, since the physical dimension(s) of the connector do not support its use with an adapter having a wider bus interface than that of the connector itself. As a result, a PCI Express ×16 adapter cannot currently be installed in a PCI Express ×8, ×4, or ×1 connector slot due to this mechanical limitation.

All current solutions to this problem use a PCI Express connector having a bus width at least as large as that of the installed adapter while wiring only a portion of the connector to the system bus for use with the adapter. For example, by wiring only eight (8) of its connections to the system integrated circuit (IC) chipset on the PCB, a PCI Express ×16 connector may be used to connect an 8-bit (single byte-sized) system bus with a PCI Express ×8 or ×16 adapter by installing the adapter into the connector slot. However, this solution requires use of a larger, more expensive PCI Express connector taking up a greater amount of space than is necessary for the electrical connection being made, and it results in unused connections. The present invention solves these problems by providing a new type of PCI Express connector that allows installation of a PCI Express adapter having a larger bus width than that of the connector itself, by including an opening (or "notch") in at least one end of the connector to physically accommodate the larger dimension (s) of the adapter.

Figure 5A:
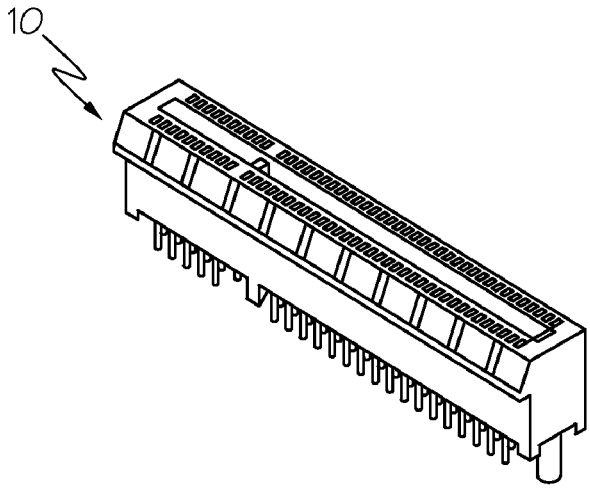
FIGS. 5A-5C are perspective views illustrating a "notched" PCI Express connector of the present invention.
Figure 5B:
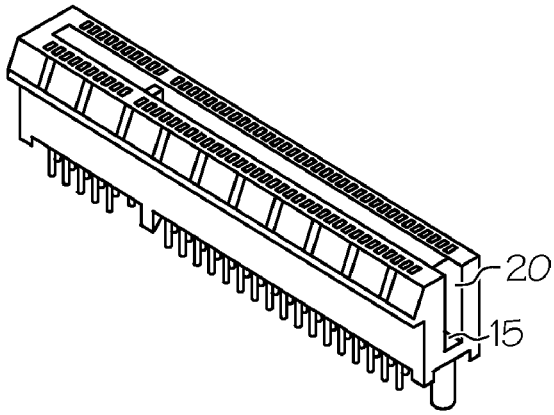
Figure 5C:
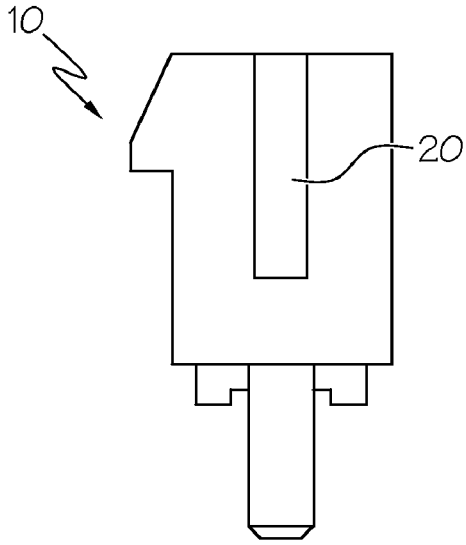
Figure 6:
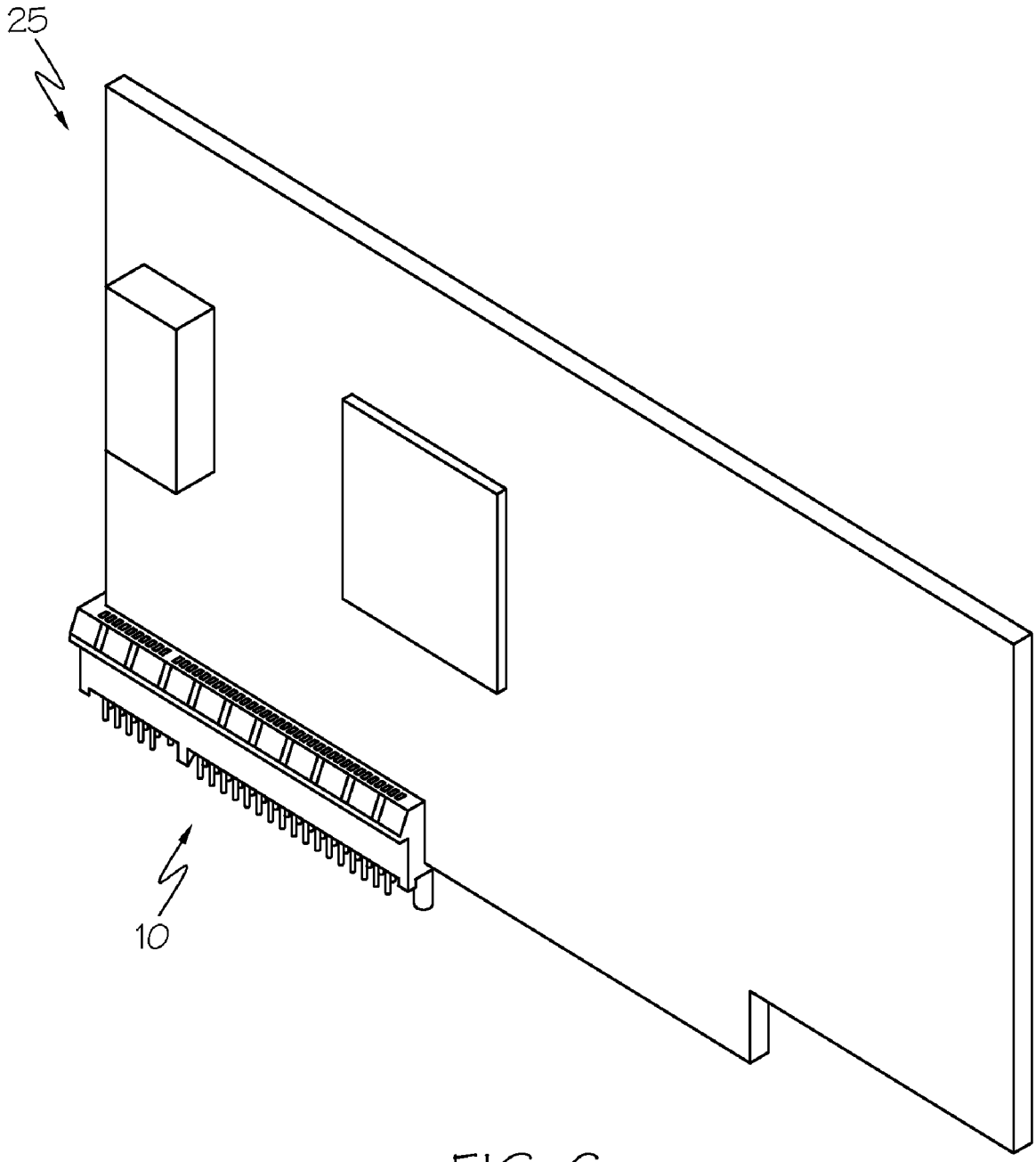
FIG. 6 is a perspective view illustrating a PCI Express adapter installed in a "notched" PCI Express connector of the present invention.

As shown in FIGS. 5A-5C, a standard PCI Express connector 10 is modified by adding an opening (or "notch") 20 to at least one end of the connector slot 15 (such as the one closest to the front of the system). The notch 20 allows PCI Express adapters 25 (i.e. "expansion cards") that are larger in dimension than the connector slot 15 to be installed (or "plugged") into the connector 10 via the slot, as shown in the example of FIG. 6 where a PCI Express ×16 adapter is installed in a PCI Express ×8 connector slot. As shown in FIGS. 5C & 7B, the notch can extend into the central region of the connector where the metal bus connection pins reside (as well as toward the bottom of the connector) to allow a PCI Express adapter card that is physically larger than the connector to fully seat into the connector as shown in FIG. 6.

Figure 7A:
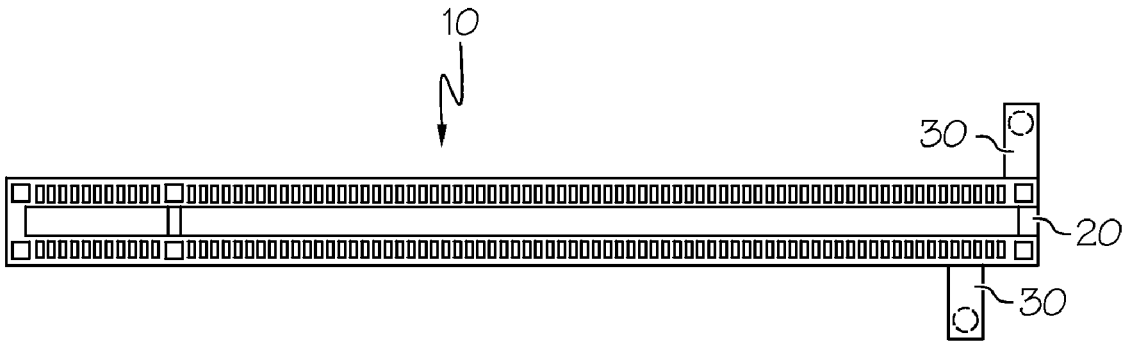
FIGS. 7A & 7B are perspective views illustrating "outriggers" added near the end(s) of the "notched" PCI Express connector of the present invention.
Figure 7B:
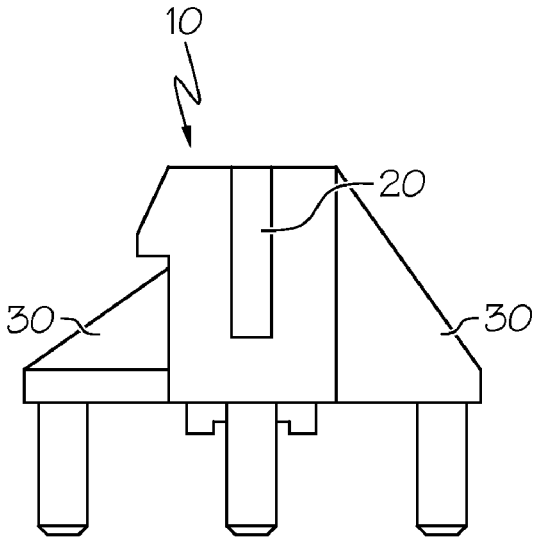

As shown in FIGS. 7A & 7B, "outrigger" support(s) 30 (made of a material such as plastic) can be added near the end(s) of the PCI Express connector 10 where a notch 20 is included to prevent the connector walls from excessively flexing outward when an adapter 25 is installed, thereby ensuring adequate pressure to complete an electrical connection between the pins inside the connector and the fingers on the expansion card. The "outriggers" on each side of the connector can be staggered (as shown in FIG. 7A) to allow multiple "notched" PCI Express connectors to be placed next to each other without creating mechanical interference problems.

Even though a PCI Express ×8 connector is illustrated in the example described herein, the "notch" technique can be applied to a PCI Express connector of any size, or to any other expansion connector using an architecture that allows for different bus widths. The "notched" PCI Express connector of this invention thus overcomes the disadvantages of the prior art by eliminating the problems experienced with current PCI Express connector/adapter configurations, while also allowing the connector to be compliant with the PCI Express specification, and it can be used to manufacture a variety of different PCI Express connectors as well as connectors for other expansion busses.

While certain preferred features of the invention have been shown by way of illustration, many modifications and changes can be made that fall within the true spirit of the invention as embodied in the following claims, which are to be interpreted as broadly as the law permits to cover the full scope of the invention, including all equivalents thereto.

What is claimed is:

1. A connector comprising a housing containing at least one slot holding one or more contacts that are configured for electrically connecting one or more electronic or computer devices in communication of data processing, addressing or control signals between the connected devices on at least one interface bus such that one or more of the connected devices has a bus width different than the bus width of the connector, wherein at least one slot is configured for installation of a device adapter having a larger bus width than the bus width of the connector and the configuration of one or more slots includes an opening in at least one end of the slot to physically accommodate one or more larger dimension(s) of an adapter, and including supports installed on opposite sides of the connector slot near an end of the connector where an opening is located and positioned at least transversely outward to the opening.

2. A connector of claim 1 wherein at least one opening extends into a central region of the connector.

3. A connector of claim 1 wherein at least one opening extends toward the bottom of the connector.

4. A connector of claim 1 wherein supports installed on opposite sides of the connector slot are in staggered positions with respect to each other.

5. A connector of claim 1 wherein the connector and connected devices are configured to satisfy the Peripheral Component Interconnect ("PCI") Express technical standard.

6. A connector of claim 5 wherein the connector is configured to satisfy the ×1 bus width and at least one adapter is configured to satisfy at least the ×2, ×4 or ×8 or ×16 or ×32 bus width of the PCI Express technical standard.

7. A connector of claim 5 wherein the connector is configured to satisfy the ×2 bus width and at least one adapter is configured to satisfy at least the ×4 or ×8 or ×16 or ×32 bus width of the PCI Express technical standard.

8. A connector of claim 5 wherein the connector is configured to satisfy the ×4 bus width and at least one adapter is configured to satisfy the at least ×8 or ×16 or ×32 bus width of the PCI Express technical standard.

9. A connector of claim 5 wherein the connector is configured to satisfy the ×8 bus width and at least one adapter is configured to satisfy at least the ×16 or ×32 bus width of the PCI Express technical standard.

10. A connector of claim 5 wherein the connector is configured to satisfy the ×16 bus width and at least one adapter is configured to satisfy at least the ×32 bus width of the PCI Express technical standard.

11. A system comprised of one or more electronic or computer devices and including at least one connector comprising a housing containing at least one slot holding one or more contacts that are configured for electrically connecting one or more of the devices in communication of data processing, addressing or control signals between the connected devices on at least one interface bus such that one or more of the connected devices has a bus width different than the bus width of the connector, wherein at least one slot is configured for installation of a device adapter having a larger bus width than the bus width of the connector and the configuration of one or more slots includes an opening in at least one end of the slot to physically accommodate one or more larger dimension(s) of an adapter, and including supports installed on opposite sides of the connector slot near an end of the connector where an opening is located and positioned at least transversely outward to the opening.

12. The system of claim 11 wherein supports installed on opposite sides of the connector slot are in staggered positions with respect to each other.

13. The system of claim 11 wherein the connector and connected devices are configured to satisfy the Peripheral Component Interconnect ("PCI") Express technical standard.

14. The system of claim 13 wherein at least one connector is configured to satisfy the ×1 bus width and at least one adapter is configured to satisfy at least the ×2, ×4 or ×8 or ×16 or ×32 bus width of the PCI Express technical standard.

15. A connector of claim 13 wherein the connector is configured to satisfy the ×2 bus width and at least one adapter is configured to satisfy at least the ×4 or ×8 or ×16 or ×32 bus width of the PCI Express technical standard.

16. The system of claim 13 wherein at least one connector is configured to satisfy the ×4 bus width and at least one adapter is configured to satisfy at least the ×8 or ×16 or ×32 bus width of the PCI Express technical standard.

17. The system of claim 13 wherein at least one connector is configured to satisfy the ×8 bus width and at least one adapter is configured to satisfy at least the ×16 or ×32 bus width of the PCI Express technical standard.

18. The system of claim 13 wherein at least one connector is configured to satisfy the ×16 bus width and at least one adapter is configured to satisfy at least the ×32 bus width of the PCI Express technical standard.

19. A method of using a connector in a system comprised of one or more electronic or computer devices that includes the steps of fabricating and installing at least one connector comprising a housing containing at least one slot holding one or more contacts that are configured for electrically connecting one or more of the devices in communication of data processing, addressing or control signals between the connected devices on at least one interface bus such that one or more of the connected devices has a bus width different than the bus width of the connector, wherein at least one slot is configured for installation of a device adapter having a larger bus width than the bus width of the connector and the configuration of one or more slots includes an opening in at least one end of the slot to physically accommodate one or more larger dimension(s) of an adapter, and including supports installed on opposite sides of the connector slot near an end of the connector where an opening is located and positioned at least transversely outward to the opening.

20. The method of claim 19 wherein supports installed on opposite sides of the connector slot are in staggered positions with respect to each other.

21. The method of claim 19 wherein the connector and connected devices are configured to satisfy the Peripheral Component Interconnect ("PCI") Express technical standard.

* * * * *